US012766666B2

(12) United States Patent
Möller

(10) Patent No.: US 12,766,666 B2
(45) Date of Patent: Oct. 20, 2026

(54) METHOD FOR CONFIGURING A DOUBLE- OR SINGLE-SIDED PROCESSING MACHINE, AND DOUBLE- OR SINGLE-SIDED PROCESSING MACHINE

(71) Applicant: Lapmaster Wolters GmbH, Rendsburg (DE)

(72) Inventor: Helge Möller, Flensburg (DE)

(73) Assignee: Lapmaster Wolters GmbH, Rendsburg (DE)

( * ) Notice: Subject to any disclaimer, the term of this patent is extended or adjusted under 35 U.S.C. 154(b) by 699 days.

(21) Appl. No.: 18/315,881

(22) Filed: May 11, 2023

(65) Prior Publication Data

US 2023/0364737 A1 Nov. 16, 2023

(30) Foreign Application Priority Data

May 12, 2022 (DE) ..... 10 2022 111 924.6

(51) Int. Cl.
*B24B 49/00* (2012.01)
*B24B 37/04* (2012.01)

(52) U.S. Cl.
CPC ..... *B24B 49/00* (2013.01); *B24B 37/042* (2013.01)

(58) Field of Classification Search
CPC ..... B24B 7/228; B24B 37/005; B24B 37/04; B24B 37/042; B24B 37/07; B24B 37/08; B24B 37/10; B24B 37/27; B24B 37/28
See application file for complete search history.

(56) References Cited

U.S. PATENT DOCUMENTS 6,299,514 B1 * 10/2001 Boller ..... B24B 37/08 451/60
9,724,800 B2 * 8/2017 Han ..... B24B 49/10
2003/0186624 A1 * 10/2003 Koike ..... B24B 49/04 430/311
2006/0040589 A1 * 2/2006 Ising ..... B24B 37/08 451/8

(Continued)

FOREIGN PATENT DOCUMENTS

CN 112672848 A 4/2021
DE 102007013058 A1 9/2008

(Continued)

*Primary Examiner* — Joel D Crandall
(74) *Attorney, Agent, or Firm* — Young Basile Hanlon & MacFarlane. P.C.

(57) ABSTRACT

A double- or single-sided processing machine and a method for configuring a double- or single-sided processing machine are described. A first working disk and a counter-bearing element are driven rotationally relative to each other. A working gap for processing of flat workpieces is formed between the first working disk and the counter-bearing element. A control apparatus actuates step-by-step or continuous deformation of the first working disk between a concave shape and a convex shape. During the deformation, the working gap width at two or more radially spaced apart locations of the first working disk is measured. The control apparatus determines measurement value averages from the measurement values. The control apparatus determines the minimum of the measurement value averages and, using the determined minimum, specifies a target value for deforming the first working disk as a starting value for the processing of a flat workpiece.

20 Claims, 4 Drawing Sheets

(56) References Cited

U.S. PATENT DOCUMENTS

| | | | | |
|---|---|---|---|---|
| 2008/0014839 | A1* | 1/2008 | Pietsch | B24B 37/08 257/617 |
| 2008/0038989 | A1* | 2/2008 | Boller | B24B 41/007 451/8 |
| 2008/0233840 | A1* | 9/2008 | Pietsch | B24B 37/28 451/41 |
| 2011/0189505 | A1* | 8/2011 | Ono | B24B 7/17 451/37 |
| 2011/0189506 | A1 | 8/2011 | Mannami et al. | |
| 2012/0164919 | A1* | 6/2012 | Kanzow | B24B 37/042 451/9 |
| 2014/0206261 | A1* | 7/2014 | Roettger | B24B 37/08 451/41 |
| 2016/0031062 | A1* | 2/2016 | Han | B24B 49/10 451/5 |
| 2017/0225292 | A1* | 8/2017 | Boller | B24B 49/08 |
| 2021/0245321 | A1 | 8/2021 | Kubota et al. | |
| 2022/0097205 | A1 | 3/2022 | Boller et al. | |

FOREIGN PATENT DOCUMENTS

| | | | | |
|---|---|---|---|---|
| DE | 102008056276 | A1 * | 5/2010 | B24B 49/00 |
| DE | 10 2006 037 490 | B4 | 4/2011 | |
| DE | 10 2016 102 223 | A1 | 8/2017 | |
| JP | 2008-235899 | A | 10/2008 | |
| JP | 2011-175726 | A | 9/2011 | |
| JP | 2022-055316 | A | 4/2022 | |
| TW | 202212048 | A | 4/2022 | |
| WO | WO-2010139397 | A1 * | 12/2010 | B24B 49/10 |

* cited by examiner

METHOD FOR CONFIGURING A DOUBLE- OR SINGLE-SIDED PROCESSING MACHINE, AND DOUBLE- OR SINGLE-SIDED PROCESSING MACHINE

CROSS-REFERENCE TO RELATED APPLICATION(S)

This application claims priority DE Patent Application No. 10 2022 111 924.6, filed May 12, 2022, the entire disclosure of which is hereby incorporated by reference.

TECHNICAL FIELD

This disclosure relates to a method for configuring a double- or single-sided processing machine and such a processing machine, and more particularly to a processing machine with a preferably annular first working disk and a preferably annular counter-bearing element, wherein the first working disk and the counter-bearing element can be driven rotationally relative to each other, and wherein a preferably annular working gap for double-sided or single-sided processing of flat workpieces, preferably wafers, is formed between the first working disk and the counter-bearing element.

BACKGROUND

For example, in double-sided polishing machines, flat workpieces are polished between preferably annular working disks. A preferably annular working gap is arranged between the working disks, in which the flat workpieces, for example wafers, are held during processing. For this purpose, what are known as rotor disks are typically arranged in the working gap, with recesses in which the workpieces are mounted in a floating manner. For processing, the working disks are driven rotationally relative to each other by means of a rotary drive and the rotor disks are also rotated in the working gap by external teeth of the rotor disks, which engage with corresponding teeth of pin rings. As a result, the workpieces are conveyed through the working gap along cycloidal paths during processing. In addition, a polishing agent, known as a slurry, is introduced into the working gap during double-sided polishing and ensures abrasive processing. In addition, in double-sided polishing machines, the working disks regularly have polishing cloths, known as polishing pads, on their surfaces delimiting the working gap.

The goal of the processing is a shape of the completely processed workpieces that is as plane-parallel as possible. The working gap geometry is of decisive importance for this. A double-sided processing machine with means for generating a global deformation of one of the working disks is known from DE 10 2006 037 490 B4. In particular, the upper working disk can be deformed between a globally concave and a globally convex shape. In the case of such a global deformation, the concave or convex shape of the working disk first results over the entire diameter of the working disk, viewed in the radial direction. The ring surface of the preferably annular working disk delimiting the working gap remains planar in itself; however, opposite ring portions of the ring surface are deformed in relation to each other so that an overall concave or convex shape results.

A double-sided processing machine with means for generating a local deformation of one of the working disks, in particular between a local convex and a local concave shape, is also known from DE 10 2016 102 223 A1. In the case of such a local deformation, the convex or, respectively, concave shape results, in the radial direction, between the inner and outer edge of the (e.g., annular) working disk. Unlike with a global deformation, in the case of a local deformation the ring portions are thus themselves deformed concavely or convexly.

The two above embodiments can be combined in a double-sided processing machine. In this way, a wide range of working gap geometries can be generated. Thus, a processing of the workpieces that is as plane-parallel as possible or, respectively, a setting of the working gap that is preferred for the workpiece quality, whether parallel or not, can be ensured at all times, for example, in the case of partial wear of the polishing cloths or in the case of changing temperatures of the components defining the working gap.

SUMMARY

The geometry of the working gap has a decisive influence on the shape and the evenness of the processed workpieces. An optimal processing result is only achieved within a narrow parameter window. Due to production tolerances and varying geometries of, for example, polishing cloths, but also in the case of modified materials of specific components of the double-sided processing machine, such as the polishing disks, or a change in the typically provided cooling circuit in the working disks for tempering during processing, the position of this parameter window is not inherent for a specific double-sided processing machine. Apart from this, the geometry changes even between different double-sided processing machines of the same type. The right processing parameters for an optimal working gap must be determined manually in a complex manner. Usual methods are iterative. This means that experimental processing is performed repeatedly, the processed workpieces are measured, and the parameters are adjusted until a suitable working gap geometry is present. Alternatives are statistical design of experiments (DoE) processes. Both procedures have in common that they require a considerable number of data points (experiments) to determine the desired working point sufficiently exactly with algebraic or statistical methods. In addition to the considerable time and material outlay of this procedure, many workpieces are produced with the processing experiments, which workpieces are outside of specifications and accordingly form rejects.

An object of this disclosure is therefore to provide a method and a double- or single-sided processing machine with which configuring for the processing of the workpieces is possible with little time and material outlay.

Embodiments in accordance with a method described herein address the object through the following steps:

a) a control apparatus actuates means for step-by-step or continuously deforming the first working disk between a concave shape and a convex shape (e.g., a deforming actuator), b) during the step-by-step or continuous deformation of the first working disk, the working gap width (i.e., a width of the working gap) at two or more radially spaced apart locations of the first working disk is measured step-by-step or continuously, and the measurement values are given to the control apparatus, c) the control apparatus determines a measurement value average in each case from the preferably weighted measurement values of the working gap width at the two or more radially spaced apart locations, and/or d) the control apparatus determines the minimum of the preferably weighted measurement value averages, and based on the determined minimum, the control apparatus specifies a target value for the means for deforming the first working disk as a starting value (e.g., a starting actuation value) for the processing of flat workpieces in the double- or single-sided processing machine.

Embodiments in accordance with another method described herein address the object by deforming, step-by-step or continuously using a deforming actuator, the first working disk between a concave shape and a convex shape, obtaining, step-by-step or continuously, during the deforming of the first working disk, measurement values of a working gap width at two or more radially spaced apart locations of the first working disk, determining measurement value averages from the measurement values of the width at the two or more radially spaced apart locations, determining a minimum of the measurement value averages, and specifying, based on the minimum, a target value for the deforming actuator as a starting actuation value for processing a flat workpiece in the double- or single-sided processing machine.

Embodiments in accordance with the double- or single-sided processing machine described herein address the object in that:

a control apparatus is provided, which is designed to actuate means for step-by-step or continuously deforming the first working disk between a concave shape and a convex shape, measuring apparatuses are provided, which are designed to measure the working gap width step-by-step or continuously at two or more radially spaced apart locations of the first working disk during the step-by-step or continuous deformation of the first working disk and to give the measurement values to the control apparatus, the control apparatus is designed to determine a measurement value average in each case from the preferably weighted measurement values of the working gap width at the two or more radially spaced apart locations, the control apparatus is designed to determine the minimum of the preferably weighted measurement value averages and, on the basis of the determined minimum, specify a target value for the means for deforming the first working disk as a starting value for the processing of flat workpieces in the double- or single-sided processing machine.

The double- or single-sided processing machine in accordance with embodiments of the invention can be in particular a double- or single-sided polishing machine. However, the double- or single-sided processing machine can also be a double- or single-sided lapping machine or double- or single-sided grinding machine. The double- or single-sided processing machine has a preferably annular first working disk and a preferably annular counter-bearing element. In a single-sided processing machine, the counter-bearing element can be designed, for example, as a simple weight or pressure cylinder. The counter-bearing element can be a preferably annular second working disk. The first working disk and the counter-bearing element can be driven rotationally relative to each other, and a preferably annular working gap for processing flat workpieces, such as wafers, is formed between the first working disk and the counter-bearing element. Where the double- or single-sided processing machine is a double- or single-sided polishing machine, at least the first working disk, preferably also the counter-bearing element or, respectively, the second working disk, can have a polishing lining (polishing pad) on its surface(s) delimiting the working gap. During processing, a polishing agent, in particular a polishing liquid (slurry), can be introduced into the working gap. The working disks can also be provided with tempering channels, through which a tempering liquid, for example cooling water, is conducted to temper the working disk(s) during operation.

The double- or single-sided processing machine desirably serves for plane-parallel processing of flat workpieces. For processing, the workpieces can be accommodated in a swimming manner in recesses of rotor disks arranged in the working gap. The first working disk and the counter-bearing element are driven rotationally relative to each other, for example by a corresponding drive shaft and at least one drive motor, during operation. It is possible that only one of the first working disk or the counter-bearing element is driven rotationally. However, both the first working disk and the counter-bearing element can also be driven rotationally, in this case typically in opposite directions. For example, in the case of a double-sided processing machine, the rotor disks can also be moved rotationally through the working gap by a suitable kinematic system during the relative rotation between the first working disk and the counter-bearing element. In this way, workpieces arranged in the recesses of the rotor disks describe cycloidal paths in the working gap. For example, the rotor disks can have teeth on their outer edges that engage with corresponding teeth of pin rings. Such machines form what is known as a planetary kinematic system.

The first working disk and/or the counter-bearing element can each be held by a support disk. Like the first working disk and the counter-bearing element, the support disks can also be annular or have at least annular support portions.

In accordance with embodiments of the invention, a control apparatus is provided. The control apparatus actuates means for deforming the first working disk between a concave shape and a convex shape step-by-step or continuously to deform the first working disk between the concave shape and the convex shape. During the step-by-step or continuous deformation of the first working disk between the convex shape and the concave shape, the thickness or, respectively, the width of the working gap is measured accordingly step-by-step or continuously at two or more radially spaced apart locations by measuring apparatuses. For example, in the case of step-by-step deformation of the first working disk, the working gap width is measured at the two or more locations at each deformation step. The working gap width is defined by the distance between the surfaces of the first working disk and of the counter-bearing element delimiting the working gap. If the first working disk and/or the counter-bearing element have a working lining, such as a polishing cloth, the distance and thus the working gap width can be formed accordingly between the working linings. The working gap width can be measured by the measuring apparatuses, for example, by distance sensors. Optical measuring apparatuses or eddy current measuring apparatuses, for example, can be considered.

After the deformation of the first working disk between the concave shape and the convex shape is completed, there are thus two or more series of measurements for the working gap width, namely for the two or more radially spaced apart measurement locations. Of course, the working gap width could also be measured and evaluated at more than two radially spaced apart measurement locations, for example, at three radially spaced apart measurement locations.

The control apparatus can also determine an average in each case from the measurement values, recorded for the respective deformation of the first working disk, of the working gap width at the two or more radially spaced apart measurement locations. The averages are thus formed in each case for a specific degree of deformation of the first working disk from the measurement values at the two or more radially spaced apart locations of the first working disk. The average can be, for example, a weighted average, in which the measurement values at the two or more radially spaced apart locations are included with a weighting factor. Such a weighting can be desired, for example, in the case of radial measuring points arranged non-symmetrically in relation to each other. There is thus a series of averages corresponding to the series of measurements for the working gap width.

The control apparatus also determines the minimum of this series of averages. The series of measurements and the series of averages can be determined for example, in the case of a step-by-step deformation of the first working disk, by a curve fit along the individual measuring points. Accordingly, the series of averages can also be determined by a curve fit. On this basis, the control apparatus can establish the minimum of the series of averages mathematically in a simple manner.

Based on the determined minimum, the control apparatus specifies a target value for the means for deforming the first working disk. This target value serves as a starting value for the processing of flat workpieces in the double- or single-sided processing machine. The target value or, respectively, the target values can be specified such that the target value or, respectively, the target values are displayed to an operating person on an operating interface so that the operating person can then actuate the means for deforming the first working disk according to the target value or, respectively, the target values. However, it is also possible for the control apparatus to actuate the means for deforming the first working disk automatically based on the target value determined from the minimum of the measurement value averages. In this case, the double- or single-sided processing machine can be configured fully automatically by the control apparatus. The control apparatus can also be a control and regulation apparatus.

In any case, the double- or single-sided processing machine is configured partially automatically by the control apparatus as a setup. The double- or single-sided processing machine can be configured accordingly without iterative processing of workpieces and subsequent measurement. The time outlay associated with the configuration is considerably shorter than in the prior art, in particular also shorter than a single processing process required for an iterative determination of the configuration parameters. With an iterative determination, a plurality of processing processes must also be performed and evaluated. In the best case, embodiments in accordance with the invention can completely avoid the production of reject workpieces.

A pressure or, respectively, a force exerted by the means for deforming the first working disk can be considered as target values for the control values of the means for deforming the first working disk. The result of the configuration process according to the invention is a working gap geometry, in particular a working gap width and a global and/or local deformation of the first working disk and, if applicable, of the counter-bearing element, with which a processing result that is satisfactory at the beginning of the process can be implemented. Of course, it may be possible to process the target value specified by the control apparatus still further, for example, to add the target value to a processing-specific or machine-specific offset value. By performing the configuration process in accordance with embodiments of the invention multiple times, the wear of components of the double- or single-sided processing machine, for example, of working linings such as polishing cloths, can also be monitored. Deterioration of the working linings thus leads to a change in the working gap width. Further wear or, respectively, a necessary replacement of the working linings can be inferred from corresponding monitoring.

According to an embodiment, the control apparatus identifies the measurement values of the working gap width, forming the minimum of the measurement value averages, at the two or more radially spaced apart locations. Then, the control apparatus specifies the actuation values of the means for deforming the first working disk corresponding to the identified measurement values of the working gap width at the two or more radially spaced apart locations as the target value. In this embodiment, the control apparatus identifies the two or more measurement values at the two or more radially spaced apart locations, the average of which forms the minimum of the measurement value averages, based on the previously determined minimum of the measurement value averages. The values, corresponding to these identified measurement values of the working gap width, for actuating the means for deforming the first working disk are then specified by the control apparatus as the target value. In this way, the target value can be specified in a particularly simple manner.

The means for deforming the first working disk can generate a global deformation of the first working disk. Additionally, or alternatively, it is possible that the means for deforming the first working disk generates a local deformation of the first working disk. It is also possible that means for globally and/or locally deforming the counter-bearing element is also provided.

As explained previously, a local concave or convex deformation, as it is known for example from DE 10 2016 102 223 A1, must be differentiated from a global concave or convex deformation, as it is known for example from DE 10 2006 037 490 B4. In the case of a local deformation, the convex or, respectively, concave shape or, respectively, deformation is present in the radial direction between the inner and outer edge of the (e.g., annular) working disk or, respectively, the annular working surface of the working disk delimiting the working gap. If the first working disk is not annular, the convex or, respectively, concave deformation is present in the radial direction between the center and the outer edge of the working disk. In the case of global deformation, the concave or convex shape results, as explained, over the entire diameter of the working disk viewed in the radial direction. However, in the case of an exclusively global deformation, the working surface is planar in each case in the radial direction between the inner and outer edge of an annular working disk or, respectively, between the center and the outer edge of a non-annular working disk.

In accordance with embodiments of the invention, the means for deforming the first working disk and/or the counter-bearing element can be both means for generating a global deformation and means for generating a local deformation. In the case of a combination of both types of deformation, the working gap can be adjusted to the respective requirements in a particularly flexible and precise way.

According to another configuration, in a first method step, the steps a) to d) may be performed with means for generating a global deformation of the first working disk, and in a second, subsequent method step, the steps a) to d) may be performed once again with means for generating a local deformation of the first working disk or of the counter-bearing element. During the second method step, the means for generating the global deformation is actuated with the target value specified after performing the first method step (i.e., a first target value). As a result of the second method step, a second target value is obtained.

It can furthermore be provided that, in a first method step, the steps a) to d) are performed with means for generating a local deformation of the first working disk, and in a second, subsequent method step, the steps a) to d) are performed once again with means for generating a global deformation of the first working disk or of the counter-bearing element. In this case, during the second method step, the means for generating the local deformation may be actuated with the target value specified after performing the first method step.

In these embodiments, a method in accordance with the invention with the steps a) to d) is executed twice in a row, namely first with a global or local deformation of the first working disk between a concave shape and a convex shape and establishing a target for actuating the means for generating the global or local deformation. The means for generating the respective other of the global or local deformation is held constant during this first portion of the method. During the second portion of the method, now with the other of the global or local deformation of the first working disk, or preferably of the counter-bearing element in the form of a second working disk, between a concave shape and a convex shape, the means for generating the first of the global or local deformation is held constant at the actuated target value established previously (i.e., a first target value) in the first portion of the method, and a target value (e.g., a second target value) is established and specified as an actuation value for the means for generating the respective other of the global or local deformation.

In this way, the means for generating the global deformation and the means for generating the local deformation can be set one after the other to a target value that is optimal for the processing result. Setting to the target values and holding during the respective portions of the method can in turn take place automatically by the control apparatus. Of course, the aforementioned two procedures can also be performed one after the other, if applicable also multiple times.

According to another embodiment, before method step a), the control apparatus can actuate means for generating an axial relative movement between the first working disk and the counter-bearing element once or multiple times so that the first working disk and the counter-bearing element are pressed against each other with their surfaces delimiting the working gap. The means for generating the axial relative movement can comprise an axial drive of the first working disk and/or of the counter-bearing element. By pressing the first working disk and the counter-bearing element together with their surfaces delimiting the working gap, a working lining of the first working disk and/or of the counter-bearing element can be compressed and any remaining liquid contained in it can be pressed out. As a result, identical starting conditions, including with regards to the working lining, for example a polishing cloth, are ensured before the beginning of the configuring process.

According to another embodiment, the means for deforming the first working disk can be designed to generate a global deformation of the first working disk. The first working disk can also be fastened to a first support disk, and a support ring can be provided on which the first support disk is suspended. Between the support ring and a ring portion of the first support disk lying radially outward from the support ring, means controllable by the control apparatus is arranged. This arrangement can apply a radial force to the first support disk over the circumference of the support ring with the aid of a force generator (e.g., a radial force generator). Such an embodiment for generating a global deformation is known, for example, from DE 10 2006 037 490 B4. It can be used as described there in the present invention.

In principle, the means for generating a global deformation of the first working disk and/or a local deformation of the first working disk or of the counter-bearing element can be hydraulic means and/or pneumatic means and/or mechanical means (e.g., a deforming actuator can be actuated using hydraulic, pneumatic and/or mechanical force). Suitable actuators for manipulating the geometry of the first working disk and/or of the counter-bearing element are provided in each case. The first working disk can be, for example, an upper working disk and the counter-bearing element can be a lower counter-bearing element, for example, a lower working disk.

As already explained, the means for deforming the first working disk can be designed to generate a local deformation of the first working disk. Means for deforming the counter-bearing element can also be provided, which is designed to generate a local deformation of the counter-bearing element.

Furthermore, the first working disk can be fastened to a first support disk and/or the counter-bearing element can be fastened to a second support disk. The means for generating the local deformation of the first working disk and/or of the counter-bearing element comprises an annular pressure volume designed between the first support disk and the first working disk and/or between the second support disk and the counter-bearing element. The pressure volume is connected to a fluid supply that can be actuated by the control apparatus such that a pressure is built up in the pressure volume and generates a specified local deformation of the first working disk and/or of the counter-bearing element. Furthermore, the first working disk can be fastened to the first support disk only in the region of its outer edge and in the region of its inner edge and/or the counter-bearing element can be fastened to the second support disk only in the region of its outer edge and in the region of its inner edge. These embodiments for generating the local deformation are known, for example, from DE 10 2016 102 223 A1. They can be used as described there in the present invention.

As already explained, the counter-bearing element can be formed by a preferably annular second working disk, wherein the first and second working disks are arranged coaxially to each other and can be driven rotationally relative to each other, wherein the working gap for double-sided or single-sided processing of flat workpieces is formed between the working disks.

A method in accordance with embodiments of the invention can be performed with a double- or single-sided processing machine in accordance with embodiments of the invention. Accordingly, a double- or single-sided processing machine in accordance with embodiments of the invention, in particular its control apparatus and its measuring apparatuses, can be designed to perform a method in accordance with embodiments of the invention.

BRIEF DESCRIPTION OF THE DRAWINGS

Embodiments of the invention are explained below in greater detail using figures.

DETAILED DESCRIPTION

Figure 1:
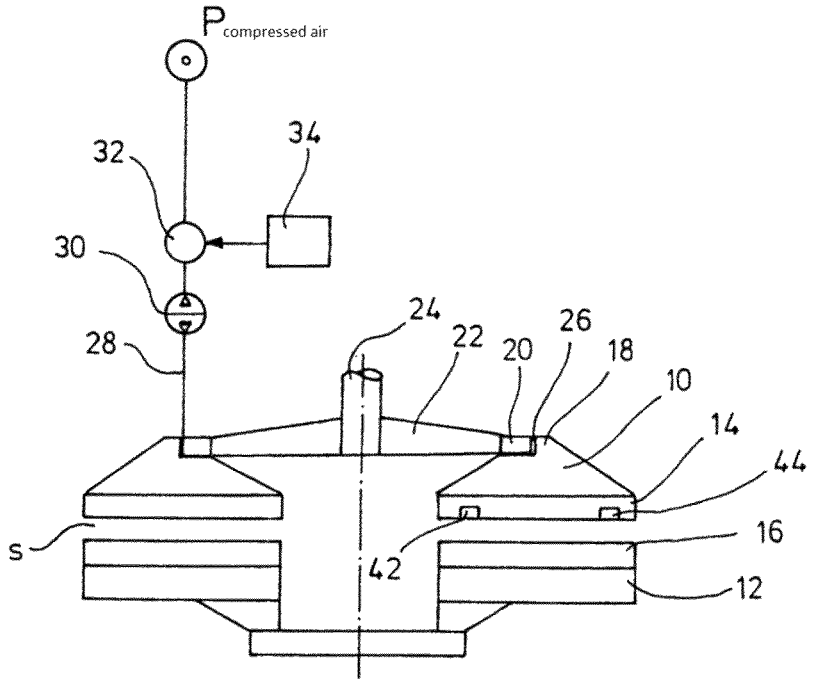
FIG. 1 shows a double-sided processing machine in a partial depiction according to a first embodiment of the teachings herein.

The double-sided processing machine shown in FIG. 1, which can be, for example, a double-sided polishing machine, has an upper support disk 10 and a lower support disk 12. Each of the upper support disk 10 and the lower support disk 12 is connected to a shaft of a rotary drive (not shown in FIG. 1). A first working disk 14 is connected to the upper support disk 10, and a second working disk 16 is connected to the lower support disk 12. The first working disk and the second working disk may be arranged coaxially to each other and may be driven rotationally relative to each other. The first working disk 14 and the second working disk 16 are each designed annularly like the upper support disk 10 and the lower support disk 12 and form between them a working gap s. The first working disk 14 and the second working disk 16 can each have a working lining, for example a polishing cloth, on their surfaces delimiting the working gap s. The upper support disk 10 and the lower support disk 12 can also be provided with a suitable tempering channel system to cause a tempering, for example cooling, during operation by passing a tempering liquid, for example cooling water, through the channel system.

The upper support disk 10 has a ring portion 18 extending upwards approximately in the middle of the radial extension of the working surface of the ring portion 18. A support ring 20, which is connected to the upper shaft 24 of the rotary drive via arms 22 arranged in a star shape, is located inside the ring portion 18. This arrangement can apply a radial force to the first support disk over the circumference of the support ring with the aid of a force generator (e.g., a radial force generator). The first support disk is lying radially outward from the support ring, where the radial force generator can apply a radial force to the first support disk over a circumference of the support ring. Through means not shown in FIG. 1, the support disk 10 is suspended on the support ring 20 so that a rotation of the shaft 24 also causes a rotation of the first working disk 14 and/or counter-bearing element.

A ring slot 26 is formed between the support ring 20 and the ring portion 18. The ring slot 26 is sealed and connected to the channel 28. The channel 28 is in connection with a pressure intensifier 30, which is supplied with variable pressure by a proportional valve 32. The depiction is only schematic. It is intended to indicate that it is possible with the aid of the pressure intensifier 30 and the proportional valve 32 to generate and maintain a specified pressure in the ring slot 26. The proportional valve 32 is actuated by a control apparatus 34, which receives measurement values of the working gap width of the working gap s, measured with the aid of a first sensor 42 and a second sensor 44 embedded in the first working disk 14 at two radially spaced apart measurement locations.

The control apparatus 34 can be or include a microprocessor, processor, or other computing component with input and output connections coupled to the components described herein. The control apparatus 34 is configured to perform the methods described herein. For example, the control apparatus 34 can be programmed to perform the methods described herein. The control apparatus 34 can include computer-readable instructions stored in a non-transitory storage medium that, when executed, causes the control apparatus 34 to perform the methods described herein. The control apparatus 34 can include a combination of hardware and software.

Figure 2:
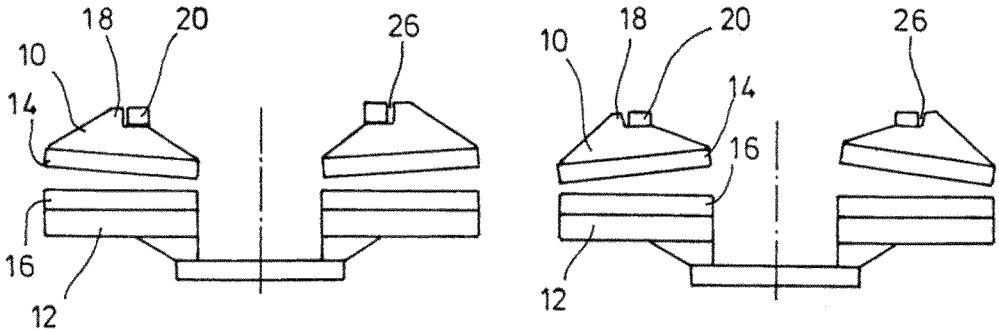
FIG. 2 shows two operating states of the double-sided processing machine shown in FIG. 1.

The left depiction in FIG. 2 shows how the upper, first working disk 14 takes on a convex shape by generating a suitable pressure in the ring slot 26. It is understood that the depiction is exaggerated. The convexity is in gap width differences in the u-range in relation to the lower, second working disk 16. The right depiction in FIG. 2 shows how, due to the described deformation of the upper support disk 10 and thus of the first working disk 14, the first working disk 14 now takes on a concave shape.

To configure the double-sided processing machine, the control apparatus 34 controls the proportional valve 32 as part of the means for generating a global deformation of the first working disk 14 for step-by-step or continuously deforming the first working disk 14 between a global convex shape as shown in the left depiction in FIG. 2 and a global concave shape as shown in the right depiction in FIG. 2. The means for generating a global deformation of the first working disk and/or a local deformation of the first working disk or of the counter-bearing element can be hydraulic means and/or pneumatic means and/or mechanical means (e.g., a deforming actuator can be actuated using hydraulic, pneumatic and/or mechanical force). During the step-by-step or continuous deformation of the first working disk 14, the width of the working gap s or, respectively, the distance between the surfaces of the first working disk 14 and the second working disk 16 delimiting the working gap, is measured at the two radially spaced apart locations of the first working disk 14 by the first sensor 42 and the second sensor 44 as measuring apparatuses and the measurement values are given to the control apparatus 34 (e.g., generate measurement values and to give the measurement values to the control apparatus). From the measurement values of the working gap width at the two or more radially spaced apart locations, the control apparatus 34 determines a measurement value average in each case. The control apparatus 34 also determines the minimum of the measurement value averages. Based on the determined minimum, the control apparatus 34 specifies a target value for the means for deforming the first working disk 14 as a starting value for the processing of flat workpieces in the double-sided processing machine (e.g., or a single-sided processing machine), in the present case a first target value for the proportional valve 32.

Figure 3:
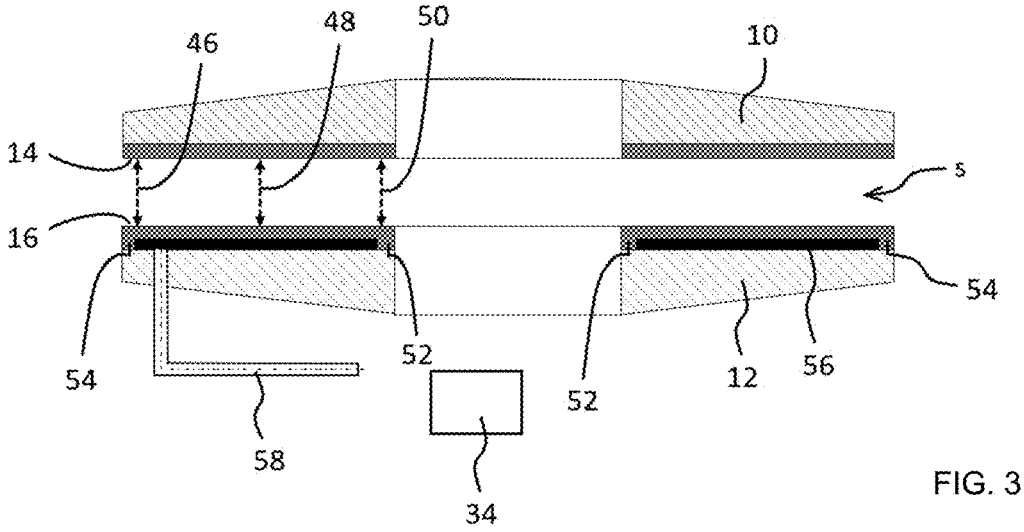
FIG. 3 is a double-sided processing machine in a partial depiction in a sectional view according to another embodiment of the teachings herein.
Figure 4:
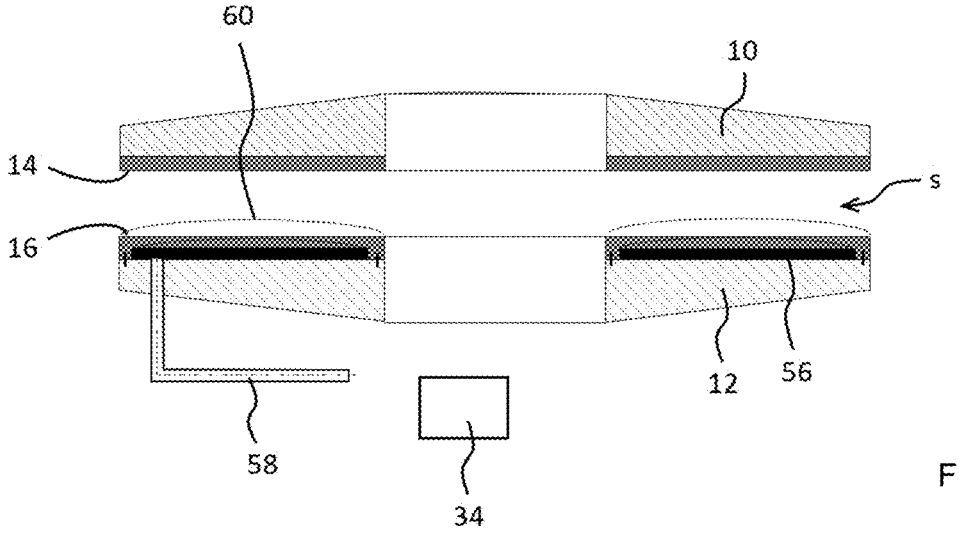
FIG. 4 is the double-sided processing machine from FIG. 3 in another operating state.
Figure 5:
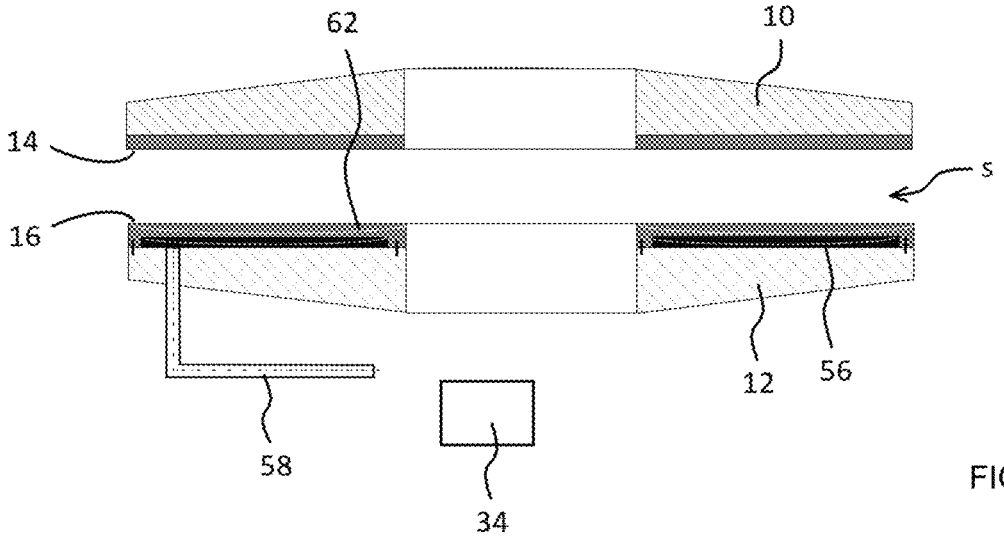
FIG. 5 is the double-sided processing machine from FIG. 3 in another operating state.

In FIGS. 3 to 5, a double-sided processing machine according to another embodiment is shown. In the embodiment according to FIGS. 3 to 5, means for generating a local deformation of the lower, second working disk 16 is provided. This embodiment can be combined with the embodiment according to FIGS. 1 and 2 such that the double-sided processing machine has both the means for generating a global deformation of the first working disk 14 shown in FIGS. 1 and 2 and the means for generating a local deformation of the second working disk 16 shown in FIGS. 3 to 5. The configuring process explained in the following for the double-sided processing machine according to FIGS. 3 to 5 can be performed accordingly independently of the configuring process explained above in reference to FIGS. 1 and 2. Alternatively, configuring process explained in the following for the double-sided processing machine according to FIGS. 3 to 5 can be performed in a second portion of the method after the configuring process explained above in reference to FIGS. 1 and 2 is completed as part of a first portion of the method. In the latter case, the control apparatus 34 actuates the means for generating the global deformation according to FIGS. 1 and 2 to the target value determined as explained above and keeps it constant during the configuring process in relation to FIGS. 3 to 5, as described below.

In FIGS. 3 to 5, some of the same reference signs are used as in FIGS. 1 and 2. In this respect, they are in principle functionally identical components, which can be combined as explained with the embodiment according to FIGS. 1 and 2.

As explained in relation to the embodiment according to FIGS. 1 and 2, the double-sided processing machine shown in FIGS. 3 and 5 also has a first annular, upper support disk 10 and a likewise second annular, lower support disk 12. An annular first working disk 14 is in turn fastened to the upper support disk 10 and an annular second working disk 16 is fastened to the lower support disk 12. Between the first working disk 14 and the second working disk 16, a likewise annular working gap s is in turn formed, in which flat workpieces, for example wafers, are processed on both sides during operation. The double-sided processing machine can be, for example, a polishing machine, a lapping machine, or a grinding machine, as in FIGS. 1 and 2.

The upper support disk 10 and with it the first working disk 14, optionally an annular counter-bearing element, and/or the lower support disk 12 and with it the second working disk 16 can be driven rotationally relative to each other by a suitable drive apparatus comprising, for example, an upper drive shaft and/or a lower drive shaft and at least one drive motor. Such a drive apparatus is known and is not shown in more detail for clarity reasons. In a manner that is also known, the workpieces to be processed can be held in the working gap s in a swimming manner in rotor disks. With a suitable kinematic system, for example a planetary kinematic system, it can be ensured that the rotor disks also rotate through the working gap s during the relative rotation of the upper support disk 10 and the lower support disk 12 or, respectively, the first working disk 14 and the second working disk 16. In the first working disk 14 or the upper support disk 10 and possibly also the second working disk 16 or the lower support disk 12, tempering channels can be designed through which a tempering fluid, for example, a tempering liquid such as cooling water, can be conducted during operation. This is also known and is not shown in more detail.

The double-sided processing machine shown in FIGS. 3 to 5 has in turn measuring apparatuses that measure the width of the working gap s at multiple, in the present case three, radially spaced apart locations (e.g., may be second-sided processing machine). FIG. 3 show a first measuring apparatus 46, a second measuring apparatus 48, and a third measuring apparatus 50 by example. Like the first sensor 42 and the second sensor 44 in the embodiment according to FIGS. 1 and 2, the measuring apparatuses according to the embodiment of FIGS. 3 to 5 also measure the distance between the surfaces of the first working disk 14 and the second working disk 16 delimiting the working gap s. As can be seen, the first measuring apparatus 46 measures the distance between the first working disk 14 and the second working disk 16 in the region of the radially outer edge of the working gap s. The third measuring apparatus 50 measures the distance between the first working disk 14 and the second working disk 16 in the region of the radially inner edge of the working gap s. The control apparatus can actuate means for generating an axial relative movement between the first working disk and the counter-bearing element once or multiple times so that the first working disk and the counter-bearing element are pressed against each other with their surfaces delimiting the working gap. The second measuring apparatus 48 measures the distance between the first working disk 14 and the second working disk 16 in the middle of the working gap s. The measurement values of the working gap width obtained by the measuring apparatuses are in turn transmitted to the control apparatus 34 (e.g., identifying multiple measurement values).

In the present case, the second working disk 16 is fastened to the lower support disk 12 only in the regions of the outer edge and the inner edge of the second working disk 16, for example, screwed along a partial circle as illustrated in FIG. 1 as a first fastening location 52 and a second fastening location 54. In contrast, the second working disk 16 is not fastened to the lower support disk 12 between the first fastening location 52 and the second fastening location 54. Instead, between the first fastening location 52 and the second fastening location 54, an annular pressure volume 56 is located between the lower support disk 12 and the second working disk 16. The pressure volume 56 is connected to a pressure fluid reservoir, for example a liquid reservoir, in particular a water reservoir, via a dynamic pressure line 58. In the dynamic pressure line 58, a pump and a control valve can be arranged. The pump and/or the control valve can be actuated by the control apparatus 34 as the means for generating a local deformation of the second working disk 16. In this way, a desired pressure that acts on the second working disk 16 can be built up in the pressure volume 56 by fluid introduced into the pressure volume 56. The pressure prevailing in the pressure volume 56 can be measured by a pressure measuring apparatus. The measurement data of the pressure measuring apparatus can also be applied to the control apparatus 34 so that the control apparatus 34 can set a specified pressure in the pressure volume 56.

Due to its freedom of movement between the first fastening location 52 and the second fastening location 54, the second working disk 16 can be brought into a convex shape locally, as indicated in FIG. 4 by a dotted line depicting a convex deformation 60, by setting a sufficiently high pressure in the pressure volume 56. If one assumes a pressure $p_0$ in the pressure volume 56 in the operating state of FIG. 3, in which the second working disk 16 has a planar shape, the convex deformation 60 of the second working disk 16 shown in FIG. 4 can be achieved by setting a pressure $p_1 > p_0$. On the other hand, a local concave deformation of the second working disk 16 can be achieved by setting a pressure $p_2 < p_0$ in the pressure volume 56, as illustrated in FIG. 5 by a dotted line depicting a concave deformation 62.

In this case, it can be seen that the second working disk 16 can take on a locally convex shape (FIG. 4) or, respectively, a locally concave shape (FIG. 5), viewed in the radial direction, between its inner edge, in the region of the first fastening location 52, and its outer edge, in the region of the second fastening location 54.

As explained above in relation to FIGS. 1 and 2, an automatic configuring process is also performed by the control apparatus 34 in the embodiment according to FIGS.

3 to 5. For this purpose, the control apparatus 34 first actuates the means for step-by-step or continuously deforming the first working disk 14 between a locally concave shape and a locally convex shape, as shown in FIG. 4 as the convex deformation 60 and in FIG. 5 as the concave deformation 62. During the step-by-step or continuous deformation of the first working disk 14, the working gap width at, in the present case, three radially spaced apart locations of the first working disk 14 is measured step-by-step or continuously and the measurement values are given to the control apparatus 34 (e.g., identifying multiple measurement values). On this basis, the control apparatus 34 determines a measurement value average at each of the radially spaced apart locations. For example, the measurement values at the three different radial locations can be weighted in that the measurement values are included in the average determination with corresponding weighting factors. The control apparatus 34 furthermore determines the minimum of the measurement value averages and, based on the determined minimum, specifies a target value for the means for deforming the second working disk 16 as a starting value for the processing of flat workpieces in the double-sided processing machine. In particular, the control apparatus 34 controls the pressure in the pressure volume 56 for this purpose via the dynamic pressure line 58 according to the determined target value.

As explained, the method described for FIGS. 3 to 5 can be performed in particular in a second portion of the method after the first portion of the method described for FIGS. 1 and 2. In this way, a complete automatic configuration of the double-sided processing machine including the global and local working gap geometry that is optimal in each case for the processing can be specified and set by the control apparatus 34. However, it is also conceivable for the method explained for FIGS. 3 to 5 to be performed without the method explained for FIGS. 1 and 2, wherein, in this case, the second working disk 16 in FIGS. 3 to 5 can be a first working disk.

Figure 6:
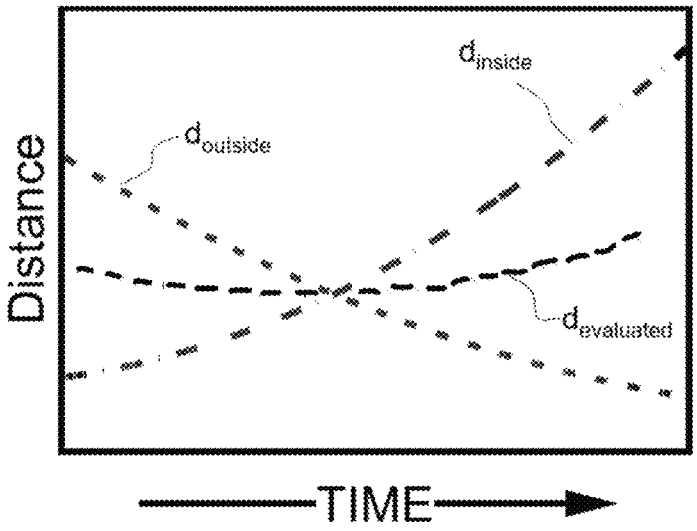
FIG. 6 is a diagram for illustrating the configuring process of the double-sided processing machine shown in FIG. 1.

In the diagram shown in FIG. 6, the configuring process according to FIGS. 1 and 2 is explained in more detail. In particular, the working gap width shown as distance on the Y-axis is a function of time shown in the X-axis. The draft shows the relationship of these variables during a deformation of the first working disk 14 between a global concave shape and a global convex shape. The curve $d_{outside}$ shows the corresponding measurement values of the second sensor 44 measuring the working gap width at the radially outer location, and the curve $d_{inside}$ shows the corresponding measurement values of the first sensor 42 measuring at the radially inner location. The curve $d_{evaluated}$ is the associated series of averages, as determined by the control apparatus 34. The minimum of this series of averages $d_{evaluated}$ can now be taken as the ideal value. In the example shown, the minimum value corresponds largely to the crossover point between the groups $d_{inside}$ and $d_{outside}$. The minimum can also be outside of the crossover point, depending on various parameters, such as the dressing formula or, respectively, wear of the polishing linings.

Figure 7:
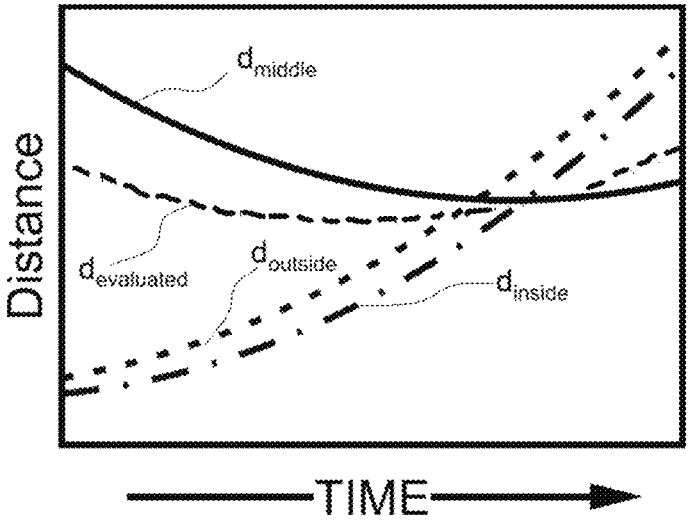
FIG. 7 is a diagram for illustrating the configuring process of the double-sided processing machine shown in FIG. 3.

FIG. 7 shows a corresponding diagram for the configuring process according to FIGS. 3 to 5. In this case, the curve $d_{outside}$ shows the series of measurements during the local deformation of the second working disk 16 between a locally concave shape and a locally convex shape at the first measuring apparatus 46 in FIG. 3, meaning at the radially outer measurement location. The curve $d_{inside}$ shows the series of measurements at the radially inner third measuring apparatus 50. The curve $d_{middle}$ shows the measurement values in the middle region at the second measuring apparatus 48 in FIG. 3. The curve $d_{evaluated}$ in turn shows a series of averages for the series of measurements. The minimum can in turn be seen as an optimal value for the start of the processing process.

The following is a list of reference signs used in this specification and in the drawings.

s Working gap
$d_{inside}$ Curve
$d_{outside}$ Curve
$d_{middle}$ Curve
$d_{evaluated}$ Curve
10 Upper support disk
12 Lower support disk
14 First working disk
16 Second working disk
18 Ring portion
20 Support ring
22 Arms
24 Upper shaft
26 Ring slot
28 Channel
30 Pressure intensifier
32 Proportional valve
34 Control apparatus
42 First sensor
44 Second sensor
46 First measuring apparatus
48 Second measuring apparatus
50 Third measuring apparatus
52 First fastening location
54 Second fastening location
56 Pressure volume
58 Dynamic pressure line
60 Convex deformation
62 Concave deformation

What is claimed is:

1. A method for configuring a double-sided or single-sided processing machine having a first working disk and a counter-bearing element, wherein the first working disk and the counter-bearing element can be driven rotationally relative to each other, and wherein a working gap for double-sided or single-sided processing of flat workpieces is formed between the first working disk and the counter-bearing element, the method comprising:

deforming, step-by-step or continuously using a deforming actuator, the first working disk between a concave shape and a convex shape;

obtaining, during the deforming of the first working disk, a series of measurement values of a working gap width at two or more radially spaced apart locations of the first working disk;

determining measurement value averages at each of the two or more radially spaced apart locations from the measurement values of the working gap width;

determining a minimum of the measurement value averages of each of the series of measurement values at each of the two or more radially spaced apart locations; and specifying, based on the minimum, a target value for the deforming actuator as a starting actuation value for processing a flat workpiece in the double-sided or single-sided processing machine.

2. The method according to claim 1, comprising:

identifying the series of measurement values that form the minimum of the measurement value averages of each of the series of measurement values at each of the two or more radially spaced apart locations; and specifying actuation values for the deforming actuator corresponding to the measurement values of each of the series of measurement values.

3. The method according to claim 1, wherein the deforming the first working disk comprises generating at least one of a global deformation or a local deformation of the first working disk.

4. The method according to claim 1, comprising:

generating at least one of a global deformation or a local deformation of the counter-bearing element.

5. The method according to claim 1, wherein the deforming the first working disk comprises generating a global deformation of the first working disk, the target value is a first target value, and the method comprises:

generating, using the first target value for actuation, a local deformation of the first working disk or of the counter-bearing element;

obtaining, during the generating the local deformation, second measurement values of the working gap width at the two or more radially spaced apart locations of the first working disk;

determining second measurement value averages from the second measurement values;

determining a minimum of the second measurement value averages; and specifying, based on the minimum of the second measurement values, a second target value for processing the flat workpiece in the double-sided or single-sided processing machine after processing the flat workpiece using the first target value.

6. The method according to claim 1, wherein the deforming the first working disk comprises generating a local deformation of the first working disk, the target value is a first target value, and the method comprises:

generating, using the first target value for actuation, a global deformation of the first working disk or of the counter-bearing element;

obtaining, during the generating the local deformation, second measurement values of the working gap width at the two or more radially spaced apart locations of the first working disk;

determining second measurement value averages from the second measurement values;

determining a minimum of the second measurement value averages; and specifying, based on the minimum of the second measurement values, a second target value for processing the flat workpiece in the double-sided or single-sided processing machine after processing the flat workpiece using the first target value.

7. The method according to claim 1, comprising:

generating an axial relative movement between the first working disk and the counter-bearing element at least once so that the first working disk and the counter-bearing element are pressed against each other with their surfaces delimiting the working gap.

8. The method according to claim 1, wherein each of the first working disk and the counter-bearing element is annular.

9. A double-sided or single-sided processing machine, comprising:

a first working disk;

a counter-bearing element, wherein the first working disk and the counter-bearing element can be driven rotationally relative to each other, and a working gap for double-sided or single-sided processing of flat workpieces is formed between the first working disk and the counter-bearing element;

a control apparatus configured to actuate a deforming actuator for step-by-step or continuous deformation of the first working disk between a concave shape and a convex shape; and measuring apparatuses configured to measure a working gap width at two or more radially spaced apart locations of the first working disk during the step-by-step or continuous deformation of the first working disk to generate measurement values and to give the measurement values to the control apparatus, wherein:

the control apparatus is configured to determine measurement value averages from the measurement values; and the control apparatus is configured to determine a minimum of the measurement value averages and, using the minimum, specify a target value for the deforming actuator as a starting value for processing a flat workpiece in the double-sided or single-sided processing machine.

10. The double-sided or single-sided processing machine according to claim 9, wherein the control apparatus is configured to identify the measurement values forming the minimum of the measurement value averages at the two or more radially spaced apart locations, and to specify actuation values for the deforming actuator corresponding to the measurement values forming the minimum.

11. The double-sided or single-sided processing machine according to claim 9, wherein the deforming actuator is configured to generate at least one of a global deformation or a local deformation of the first working disk.

12. The double-sided or single-sided processing machine according to claim 11, wherein the first working disk fastened to a first support disk, and comprising:

a support ring on which the first support disk is suspended; and a radial force generator controllable by the control apparatus and arranged between the support ring and a ring portion of the first support disk lying radially outward from the support ring, wherein the radial force generator can apply a radial force to the first support disk over a circumference of the support ring.

13. The double-sided or single-sided processing machine according to claim 9, comprising:

a second deforming actuator configured to at least one of globally deform or locally deform the counter-bearing element.

14. The double-sided or single-sided processing machine according to claim 13, wherein each of the deforming actuator and the second deforming actuator is actuated using hydraulic, pneumatic, or mechanical force.

15. The double-sided or single-sided processing machine according to claim 9, wherein:

at least one of the first working disk is fastened to a first support disk or the counter-bearing element is fastened to a second support; and the deforming actuator comprises an annular pressure volume designed between the first support disk and the first working disk, which annular pressure volume is connected to a fluid supply that can be actuated by the control apparatus such that a pressure is built up in the annular pressure volume and generates a specified local deformation of the first working disk.

16. The double-sided or single-sided processing machine according to claim 9, wherein at least one of:

the first working disk is fastened to a first support disk only in a region of its outer edge and in a region of its inner edge; or the counter-bearing element is fastened to a second support disk only in the region of its outer edge and in the region of its inner edge.

17. The double-sided or single-sided processing machine according to claim 9, wherein:

the counter-bearing element is formed by a second working disk;

the first working disk and the second working disk are arranged coaxially to each other and can be driven rotationally relative to each other; and the working gap for double-sided or single-sided processing of flat workpieces is formed between the first working disk and the second working disk.

18. The double-sided or single-sided processing machine according to claim 9, wherein to actuate the deforming actuator comprises to actuate the deforming actuator to generate a global deformation of the first working disk, the target value is a first target value, and the control apparatus is configured to:

generate, using the first target value for actuation, a local deformation of the first working disk or of the counter-bearing element;

obtain, during generation of the local deformation, second measurement values of the working gap width at the two or more radially spaced apart locations of the first working disk;

determine second measurement value averages from the second measurement values;

determine a minimum of the second measurement value averages; and specify, based on the minimum of the second measurement values, a second target value for processing the flat workpiece in the double-sided or single-sided processing machine after processing the flat workpiece using the first target value.

19. The double-sided or single-sided processing machine according to claim 9, wherein to actuate the deforming actuator comprises to actuate the deforming actuator to generate a local deformation of the first working disk, the target value is a first target value, and the control apparatus is configured to:

generate, using the first target value for actuation, a global deformation of the first working disk or of the counter-bearing element;

obtain, during generation of the global deformation, second measurement values of the working gap width at the two or more radially spaced apart locations of the first working disk;

determine second measurement value averages from the second measurement values;

determine a minimum of the second measurement value averages; and specify, based on the minimum of the second measurement values, a second target value for processing the flat workpiece in the double-sided or single-sided processing machine after processing the flat workpiece using the first target value.

20. The double-sided or single-sided processing machine according to claim 9, wherein, before the step-by-step or continuous deformation of the first working disk, the control apparatus is configured to cause an axial relative movement between the first working disk and the counter-bearing element at least once so that the first working disk and the counter-bearing element are pressed against each other with their surfaces delimiting the working gap.

* * * * *